United States Patent [19]

Gaus

[11] 4,074,070

[45] Feb. 14, 1978

[54] SUPERSONIC SIGNAL LINEARIZES LOUDSPEAKER OPERATION

[75] Inventor: Harry Gaus, Kronberg, Taunus, Germany

[73] Assignee: Braun A.G., Frankfurt, Germany

[21] Appl. No.: 617,825

[22] Filed: Sept. 29, 1975

[30] Foreign Application Priority Data

Oct. 2, 1974 Germany ..... 2446982

[51] Int. Cl.[2] ..... H04R 3/04; H04R 3/14

[52] U.S. Cl. ..... 179/1 D; 179/1 SS

[58] Field of Search ..... 179/1 R, 1 SS, 1 D, 179/1 A, 1 F, 1 C, 180, 111 R, 115.5 H, 1 GA; 333/28 R, 70 R

[56] References Cited

U.S. PATENT DOCUMENTS

| | | | |
|---|---|---|---|
| 1,648,120 | 11/1927 | Harrison | 179/180 |
| 3,135,838 | 6/1964 | Wright | 179/111 R |
| 3,160,715 | 12/1964 | Son Gussing | 179/111 R |
| 3,668,335 | 6/1972 | Beveridge | 179/111 R |
| 3,944,757 | 3/1976 | Tsukamoto | 179/115.5 H |

*Primary Examiner*—Kathleen H. Claffy
*Assistant Examiner*—E. S. Kemeny
*Attorney, Agent, or Firm*—Richard A. Wise; Oistein J. Bratlie; Donald E. Mahoney

[57] ABSTRACT

A loudspeaker driver system linearizes loudspeaker operation by superimposing a high frequency (supersonic) signal on the low frequency (audio) signal. Features include a special crossover network for a multispeaker system, and an acoustic filter formed of perforated discs.

11 Claims, 4 Drawing Figures

Fig. 1
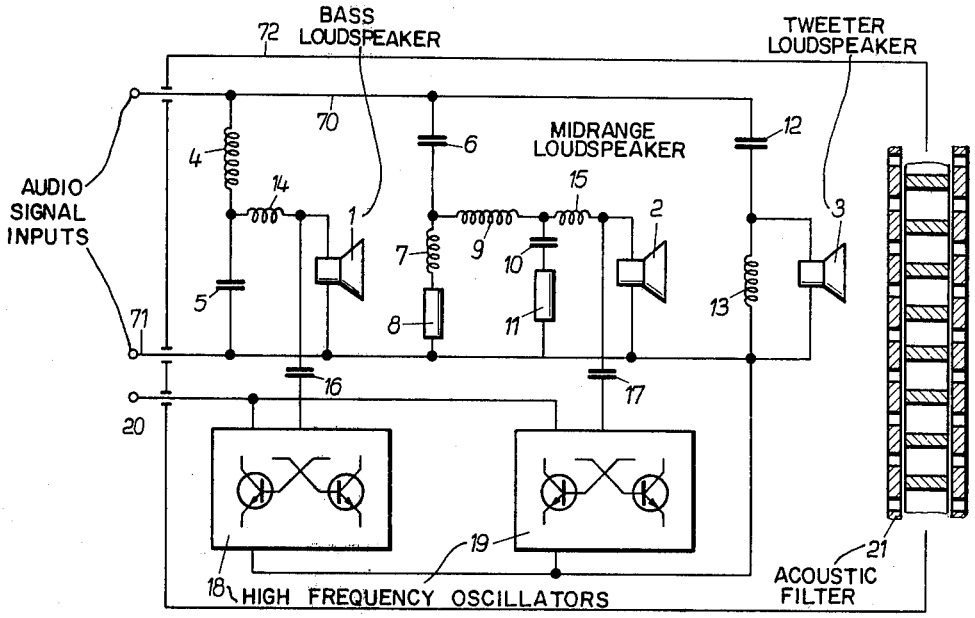
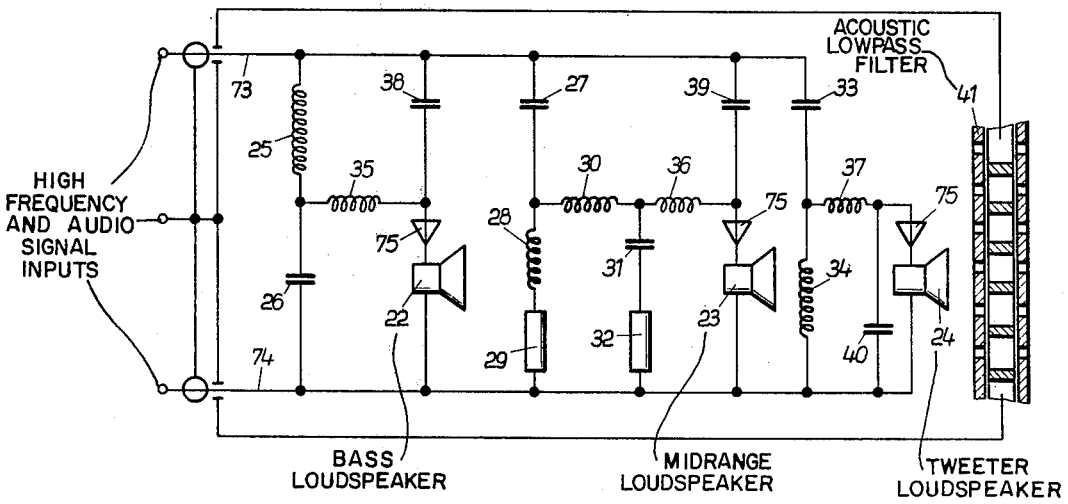
Fig. 2

SUPERSONIC SIGNAL LINEARIZES LOUDSPEAKER OPERATION

BACKGROUND OF THE INVENTION

1. Field of the Invention

This invention relates to a process and apparatus for operating loudspeakers, and more particularly, to a process and apparatus for operating loudspeakers in response to a high frequency signal superimposed on a low frequency sound signal to minimize sound distortion.

2. Description of the Prior Art

With the exception of an ion loudspeaker, which operates without a diaphragm, most loudspeaker systems using a diaphragm are afflicted with common fundamental deficiencies. In such loudspeaker systems, the quality of sound transmission is substantially determined by the quality of a loudspeaker diaphragm and to a lesser extent by associated loudspeaker electronic circuits. The usual loudspeaker system includes a fixed diaphragm for coupling sound vibrations to air, and a driver system responsive to an electrical current or voltage signal for producing mechanical forces which vibrate the diaphragm. The mechanical forces are substantially proportional to the magnitude of the current or voltage signal. Since the diaphragm has a mass which vibrates or changes position in proportion to the magnitude of the driver system output signals, the mean or average position of the diaphragm is maintained by operating the loudspeaker as a linear oscillator having one or more natural resonant frequencies. As a consequence, a diaphragm characteristic transmission curve of sound pressure with respect to frequency is determined by one or more resonance curves. These curves are additionally influenced by diaphragm radiation resistance or the coefficient between radiation and efficiency of a diaphragm having finite dimensions.

In typical loudspeaker systems, the total auditory frequency range is usually divided into two or more predetermined frequency ranges in order to obtain an approximately linear sound pressure curve over the entire auditory range. Signals within these frequency ranges are coupled to especially designed loudspeaker systems having diaphragms adapted to efficiently transmit acoustic signals within predetermined frequency bandwidths.

Prior art loudspeaker systems are inherently narrow band or have a limited range of frequency response. For example, it is difficult to reproduce relatively low (1 Hz) or relatively high (20 KHz) frequencies. In addition to having a relatively poor frequency response, this narrow band characteristic of prior art loudspeakers also produces phase distortion and erroneous pulse and transient response. A prior art solution to this problem has been to increase self-damping of the diaphragm. However, an increase in self-damping often results in a decrease in loudspeaker efficiency. The decrease in loudspeaker efficiency can be offset by modern transistor amplifiers adapted to amplify relatively low power signals to provide the desired power at the output of a loudspeaker system.

Modern loudspeakers, especially systems for middle and high frequency ranges, are so thoroughly damped that diaphragm motion is substantially determined by active mechanical or viscous elastic damping and less by blind or mass damping. Viscous elastic damping is achieved by impregnating a bead portion or radiation surface of the diaphragm with relatively tough elastic polymers. Such materials not only provide a desired friction drag proportional to velocity but also a diaphragm spring characteristic which depends on the diaphragm velocity. As a consequence, the diaphragm spring deviates from an ideal expansion and contraction along a straight line in response to an electric field and current signal. The diaphragm spring typically splits into two direction dependent branches resulting in a hysteresis loop which produces undesirable nonlinear distortions of sound.

A similar sound distortion problem occurs with glide centered loudspeakers which are guided by means of a rigid slide bearing instead of by means of a centering spider such as used in a cone or taper loudspeaker. A rigid slide bearing is advantageously used with bass loudspeakers since they permit relatively small loudspeaker systems to radiate sound signals with relatively large amplitudes. However, problems entailed in the use of a rigid slide bearing in a glide centered loudspeaker involving a difference between adhesive and sliding friction producing nonlinear distortions of sound and mechanical hysteresis have not hitherto been solved.

SUMMARY OF THE INVENTION

A loudspeaker system is arranged to operate with minimum sound distortion by arranging apparatus comprising an amplifier, and a multipath loudspeaker unit with frequency cross-over network means for superimposing a high frequency oscillation on a low frequency sound signal coupled to a driving system for the loudspeaker system.

BRIEF DESCRIPTION OF THE DRAWINGS

FIG. 1 is a schematic of a loudspeaker system with three loudspeakers and an acoustic filter arranged according to the invention.

FIG. 2 is a schematic of a three-way frequency cross-over network for three loudspeakers.

DESCRIPTION OF THE PREFERRED EMBODIMENT

Figure 3:
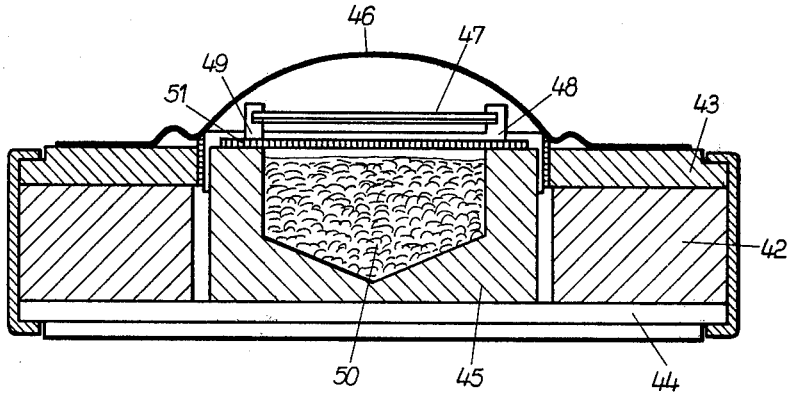
FIG. 3 is a schematic of a loudspeaker.

Nonlinear distortions of sound are minimized according to the invention by linearly superimposing a high frequency oscillation or bias signal, in the range from 20 KHz to several hundred KHz, on a low frequency sound signal. The combined low and high frequency signals are coupled to a driver system for at least one loudspeaker system. The high frequency oscillation may be a square-wave pulse having a fundamental frequency in the range of 40 KHz to 100 KHz. The high frequency square wave pulse and the low frequency sound signal may be amplified by a low frequency power amplifier. The amplitude of the high frequency signal is controlled, in a manner well-known in the art, to avoid clipping of the high frequency bias signal together with large excursions of the sound signal by the low frequency power amplifier. To maintain the efficiency of the low frequency power amplifier, a carrier isolating choke coil or inductor may be connected in series with a conductive line on which carrier energy is applied to impede conduction of carrier energy beyond the choke coil. The choke also serves to protect a tweeter loudspeaker from thermal overload. Modern loudspeaker boxes are electrically assembled in such a way that the carrier signal is least effective at the bass and midrange speakers while the aforementioned nonlinear sound distortions could hardly appear at the tweeter because of its small diaphragm amplitudes.

Referring to FIG. 1, there is shown a schematic of a loudspeaker system having a glide centered type bass loudspeaker 1, a midrange loudspeaker 2, a tweeter loudspeaker 3, and multivibrators 18, 19 for generating a relatively high frequency oscillation. Three cross-over networks are arranged, as known in the art, to distribute the frequency band between the three loudspeakers 1, 2, and 3. The first cross-over network comprises a serial connection of coil 4 and condensor 5 across conductive leads 70 and 71 for coupling signals within a first predetermined bandwidth to the loudspeaker 1. The second cross-over network comprises a serial connection of condensor 6, coil 7, and resistor 8 across conductive leads 70 and 71 and a serial connection of coil 9, condensor 10, and resistor 11 coupled in parallel across the serial connection of coil 7 and resistor 8. The second cross-over network is arranged to couple signals within a second predetermined bandwidth to the loudspeaker 2. The third cross-over network comprises a serial connection of condensor 12 and coil 13 across conductive leads 70 and 71 for coupling signals within a third predetermined bandwidth to the loudspeaker 3. A low frequency sound signal may be coupled to the loudspeakers 1, 2, and 3 via the conductive leads 70 and 71. A serial connection of coil 14 and condensor 16 form a highpass filter connected between multivibrator 18 and a junction between coil 4 and condensor 5 for superimposing the high frequency or carrier signal on the sound signal coupled to the loudspeaker 1. The coil 14 is a carrier isolating choke coil or inductor arranged to impede conduction of carrier energy to the junction between coil 4 and condensor 5. A serial connection of coil 15 and condensor 17 form a highpass filter connected between multivibrator 19 and a junction between coil 19 and condensor 10 for superimposing a high frequency signal on the sound signal coupled to the loudspeaker 2. The coil 14 is a carrier isolating coil or inductor arranged to impede conduction of carrier energy to the junction between coil 9 and condensor 10. Since the bass and midrange speakers 1 and 2, respectively, have different characteristics, two separate multivibrators, 18 and 19, are used to provide high frequency oscillations that differ in frequency and amplitude. Multivibrator circuit 18 is suitably arranged to provide a first predetermined high frequency signal coupled to the bass loudspeaker 1. The multivibrator 19 is suitably arranged to provide a second predetermined high frequency oscillation coupled to the midrange speaker 2. A supply voltage from an amplifier network, not shown, is coupled to the multivibrator circuits 18 and 19 via conductive line 20.

It is desirable to avoid ultrasonic radiation or the radiation of signals at frequencies above the audio frequency range since they could interfere with operation of video devices. For this reason, the described loudspeaker system includes an acoustic filter 21 arranged to transmit audio frequency signals and attenuate ultrasonic or high frequency signals. An example of a suitable acoustic filter 21 is a blind damping member or reflection filter. It is well-known in the prior art that perforated disks, honey-combed disks, or flow resistances may be arranged to form a suitable reflection filter. Because of the Doppler effect in speaker systems, it is desirable that the acoustic filter 21 have a relatively broad operating bandwidth.

In operating a multipath loudspeaker system from a pulse width modulated amplifier, it is desirable to arrange for the bass or midrange loudspeaker systems to have a second minimum substantially at the carrier frequency. However, in the tweeter loudspeaker system the damping should increase rapidly beyond the audio frequencies since the tweeter is arranged to transmit signals at such frequencies. The high frequency oscillators or multivibrators 18 and 19 are preferably housed in the loudspeaker box 72 to avoid undesirable radiations from connecting cables.

A method of operating the loudspeaker systems according to the invention is described below. A relatively high frequency auxiliary motion is superimposed on a steady diaphragm motion. The high frequency auxiliary motion is a result of the high frequency bias signal and the steady diaphragm motion is the result of the low frequency sound signal. As described above, the steady diaphragm motion may be hindered by dry friction in a glide centered type loudspeaker or by viscous elastic damping of a loudspeaker diaphragm. The dependence of the diaphragm damping and spring parameters on direction and speed of the diaphragm is partially eliminated by the high frequency auxiliary force or motion. A somewhat analogous technique is used in high frequency bias magnetization of a magnetic tape where hysteresis caused by friction like inhibition of re-magnetization together with noise and splitting or filtering of the operating characteristic is generally removed by a high frequency auxiliary magnetic exertation. To achieve the desired similar effects with loudspeakers, the sound signal and a relatively higher frequency signal can be superimposed linearly on a vibration coil, not shown, located inside each of the loudspeakers 1, 2, and 3. It is also possible to modulate the high frequency signal with the sound signal. However, the modulation process sould be demodulated by a linear process, such as by integration in the driver system. Pulse width modulation, impulse phase modulation, or phase height modulation are examples of suitable modulation processes. Pulse width modulated low frequency amplifiers are well-known in the prior art but have not previously been used in loudspeaker systems.

Figure 4:
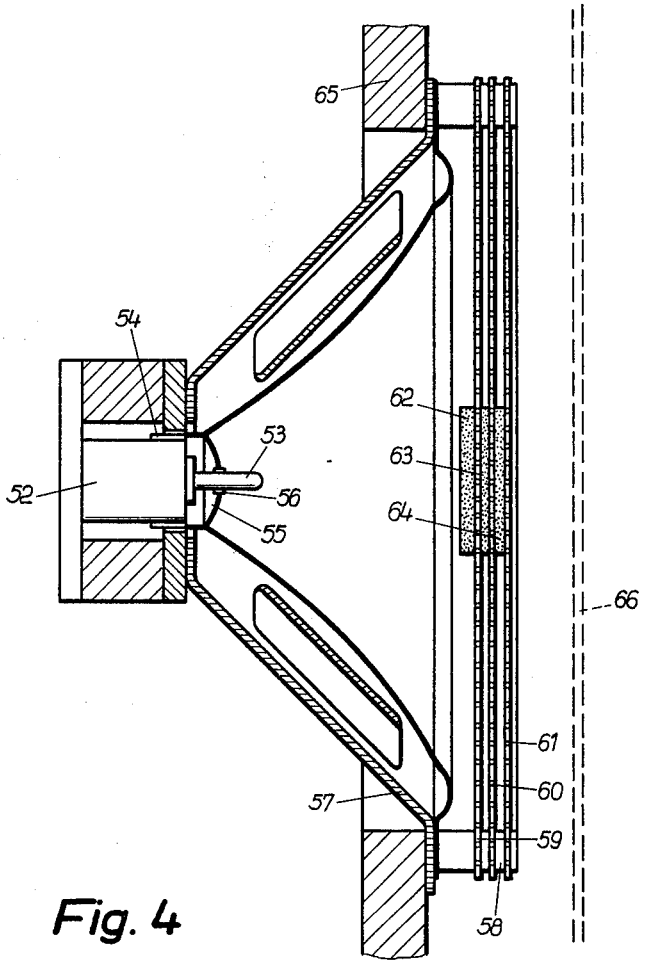
FIG. 4 is a schematic of another embodiment of a loudspeaker.

Referring to FIG. 2, there is shown a three-way cross-over loudspeaker network for operating a glide centered type bass loudspeaker 22, such as shown in FIG. 4, a midrange loudspeaker 23, and tweeter loudspeaker 24. These loudspeakers 22, 23, and 24 and associated circuitry are operated in response to a signal from a pulse width modulated amplifier or analog amplifier with a superimposed high frequency. As described above, the first cross-over network for the bass loudspeaker 22 comprises a serial connection of coil 25 and condensor 26 across conductive lines 73 and 74. The second cross-over network for the midrange loudspeaker 23 comprises a serial connection of condensor 27, coil 28, and resistor 29 across conductive lines 73 and 74. The second cross-over network further includes a serial connection of coil 30, condensor 31 and resistor 32 coupled in parallel across the serial connection of coil 28 and resistor 29. The third cross-over network comprises a serial connection of coil 34 and condensor 33 across the conductive lines 73 and 74. However, such an arrangement has a disadvantage in that the high frequency signal is undesirably coupled into the tweeter loudspeaker 24 which cannot be heavily loaded thermally. Stray impedances provide a conductive path for high frequency current to the bass and midrange speakers 22 and 23. Inductance 35 and capacitance 38 are arranged to conduct the carrier or the superimposed high frequency signal in a desired manner to the bass loudspeaker 22. Inductance 36 and capacitance 39 are arranged to conduct the carrier or the superimposd high frequency signal in a desired manner to the midrange loudspeaker 23. Inductance 37 and capacitance 40 are arranged to conduct the carrier or the superimposed high frequency in a desired manner to the tweeter loudspeaker system 24. It is understood that conductive lines and interior connections are shielded against high frequency radiation. Radiation of ultrasonic signals is substantially prevented by an acoustic filter 41. Because of the extraordinarily broad spectrum of the pulse width modulated signal, filter 41 is suitably arranged as an acoustic lowpass filter, possibly in the form of a delay line.

Referring to FIG. 3, there is shown a schematic of a dynamic loudspeaker comprising a magnetic ring 42, a pole plate 43, a perforated disk 44, a pole core 45, and a cap-shaped diaphragm 46, having an internally disposed piezo-vibrator 47 or driver system in the form of a rectangular plate. The piezo-vibrator 47 is mounted on support members 48 and 49 formed from elastic material such as rubber The length of the shorter edge of the piezo-vibrator 47 is substantially $\lambda/2$ where $\lambda$ is the wavelength at the highest operating frequency. A damping mass 50 is located within the hollow core 45 and is arranged to prevent standing wave resonances within the cap diaphragm 46. Undesired damping of relatively high frequency acoustic signals in the damping mass 50 is reduced by a reflective filter comprising an appropriately tuned perforated disk 51 disposed between the damping mass 50 and the piezo-vibrator 47.

Referring to FIG. 4, there is shown a schematic of an electrodynamic glide centered type bass loudspeaker arranged to be operated with a pulse width modulated amplifier, not shown, or with a superimposed high frequency voltage. The loudspeaker is arranged to have a guide pin 53 attached to a pole coil 52. The guide pin 53 extends through a glide socket 56 in a diaphragm dome 55. A vibration coil 54 is arranged to move on the guide pin 53. An acoustic lowpass filter 58 for attenuating relatively high frequency acoustic signals is located on a loudspeaker basket 57 since portions of the diaphragm 55 in the vicinity of the vibration coil 54 radiate ultrasound or acoustic signals at frequencies exceeding 20,000 Hz. The acoustic lowpass filter 58 may be formed from three-wire or synthetic networks 59, 60, and 61 which are separated from one another by a length of $\lambda/4$, where $\lambda$ is the wavelength at a predetermined cutoff frequency. Fibrous or porous disks 62, 63, and 64, commonly referred to as flow resistances, are adapted to simultaneously provide intermediate support for the wire networks 59, 60, and 61 and additional vibration damping around the center of the loudspeaker. The amplitude of the diaphragm 55 excursions with respect to high frequencies is minimum at edges of the diaphragm 55. For this reason, the radiation from the diaphragm edges is minimum. As in the prior art, the loudspeaker may be enclosed within an air tight box 65 and a visual screen 66 may be located in front of the acoustic lowpass filter 58.

The invention has been shown and described with reference to a preferred embodiment. Other arrangements can readily be devised in accordance with the disclosed principles by those skilled in the art and will fall within the scope of the invention as defined in the following claims.

What is claimed as new and desired to be secured by Letters Patent of the United States is:

1. A process for minimizing audio distortions in electrodynamic loudspeaker apparatus having first, second, and third loudspeaker systems each having a driving system including a diaphragm connected to a coil moving in response to electrical signals, which comprises:

superimposing a high frequency oscillation signal on a low frequency audio signal coupled to said movable coils;

vibrating said diaphragms in response to said high frequency oscillation signal and said low frequency audio signal; and providing minimum damping of said high frequency signal coupled to said driving system of said first and second loudspeaker systems, and an increase in damping for signals at frequencies above an auditory frequency range coupled to said driving system of said third loudspeaker system.

2. A process as recited in claim 1, wherein the step of superimposing said high frequency oscillation signal includes superimposing a high frequency oscillation signal in the form of a square wave pulse having a fundamental frequency substantially in the range of 40 to 100 KHz.

3. A process as recited in claim 1, further including amplifying said high frequency oscillation signal and said sound signal in an amplifier.

4. Loudspeaker apparatus comprising:

first, second, and third electrodynamic loudspeaker systems each having a driving system means including a diaphragm connected to a coil moving in response to electrical signals;

means for superimposing a high frequency oscillation signal on a low frequency audio signal coupled to said coils of said driving systems to vibrate said diaphragms in response to said high frequency oscillation signal and said low frequency audio signal; and frequency cross-over network means for said first, second, and third loudspeaker systems, said cross-over network means providing a minimum damping of said high frequency oscillation signal coupled to said driving system means of said first and second loudspeaker systems, and an increase in damping for signals at frequencies above an auditory frequency range coupled to said driving system means of said third loudspeaker system.

5. Apparatus according to claim 4, wherein said means for superimposing a high frequency oscillation signal on a low frequency sound signal include a multivibrator.

6. Loudspeaker apparatus according to claim 4, wherein said loudspeaker system includes glide centering means.

7. Loudspeaker apparatus according to claim 4, wherein said driving system means includes a cap-shaped diaphragm housing a piezo-vibrator means attached to a pole core means.

8. Loudspeaker apparatus according to claim 7, further including damping means disposed within said pole core means to prevent standing wave resonances within said cap diaphragm.

9. Apparatus according to claim 8, further including a reflection filter disposed between said damping means and said piezo-vibrator means to prevent damping of high frequency signals by said damping means.

10. Loudspeaker apparatus according to claim 4, further including an acoustic filter means attached to said loudspeaker systems to transmit audio frequency signals and attenuate ultrasonic signals.

11. Loudspeaker apparatus according to claim 10, wherein said acoustic filter means is an acoustic reflection filter formed from an arrangement of perforated disks.

* * * * *